US006390306B1

(12) United States Patent
Audet et al.

(10) Patent No.: US 6,390,306 B1
(45) Date of Patent: May 21, 2002

(54) PRINTING PLATE STORAGE AND TRANSPORTATION SYSTEM

(75) Inventors: Roger L. Audet, Salem, NH (US); Salvator J. Calascibetta, Haverhill, MA (US)

(73) Assignee: Agfa Corporation Law & Patent Department, Wilmington, MA (US)

( * ) Notice: Subject to any disclaimer, the term of this patent is extended or adjusted under 35 U.S.C. 154(b) by 0 days.

(21) Appl. No.: 09/224,631

(22) Filed: Dec. 31, 1998

(51) Int. Cl.[7] ..... A47G 19/08

(52) U.S. Cl. ..... 211/41.1; 206/308.15

(58) Field of Search ..... 211/41.1, 126.1, 211/206, 189; 40/649; D19/32, 33; 281/42, 45, 29, 19.2, 50; 206/313, 308.15; 229/80

(56) References Cited

U.S. PATENT DOCUMENTS

| | | | | | |
|---|---|---|---|---|---|
| 761,119 | A | * | 5/1904 | Weston, Jr. | 40/649 |
| 1,294,657 | A | * | 2/1919 | Harding | 281/45 |
| 2,030,634 | A | * | 2/1936 | Holloway | 281/45 X |
| 2,183,992 | A | * | 12/1939 | Hearn et al. | 211/126.1 |
| D154,300 | S | * | 6/1949 | Morris | D74/9 |
| 3,224,573 | A | * | 12/1965 | Way | 206/313 X |
| 3,458,216 | A | * | 7/1969 | Harrison | 281/45 |
| 3,710,977 | A | * | 1/1973 | Van Den Enden et al. | 221/102 |
| 3,980,178 | A | * | 9/1976 | Schidlowski | 206/313 |
| 4,009,784 | A | * | 3/1977 | Elias et al. | 211/46 |
| 4,127,155 | A | * | 11/1978 | Hydorn | 150/1.7 |
| 4,411,360 | A | * | 10/1983 | Gardineer, Jr. et al. | 206/313 |
| 4,660,959 | A | * | 4/1987 | Schoen | 355/3 R |
| 4,773,530 | A | * | 9/1988 | Holtzman et al. | 206/232 |
| 5,086,923 | A | * | 2/1992 | King et al. | 206/313 X |
| D329,943 | S | * | 10/1992 | Laszlo | D19/33 |
| 5,207,717 | A | * | 5/1993 | Manning | 206/232 |
| D352,733 | S | * | 11/1994 | French et al. | D19/32 |
| 5,535,898 | A | | 7/1996 | Burgess, Sr. et al. | 211/206 |
| D384,102 | S | * | 9/1997 | Osiecki et al. | D19/32 |
| D384,972 | S | * | 10/1997 | French et al. | D19/32 |
| 5,692,607 | A | * | 12/1997 | Brosmith et al. | 206/313 X |
| D393,875 | S | * | 4/1998 | Brooks | D19/33 |
| 6,022,033 | A | * | 2/2000 | Landesman et al. | 280/47.35 |

OTHER PUBLICATIONS

Catalog—Foster's Vertical Rack Plate Storage System—p. 27—model# 772.

* cited by examiner

*Primary Examiner*—David M. Purol
*Assistant Examiner*—Khoa Tran
(74) *Attorney, Agent, or Firm*—Alfred A. Standnicki; Edward L. Kelley

(57) ABSTRACT

An apparatus which is capable of storing a plurality of printing plates includes a sleeve having one open end which receives the printing plates and a handle connected to the sleeve. The sleeve comprises two mutually-opposed surfaces which enclose all but one edge of each received printing plate. The edges are enclosed such that all of the edges, but one, are unexposed external to the apparatus and such that the one edge which is exposed is only partially exposed. The sleeve also includes a plurality of stiffening members therein for maintaining substantial rigidity thereof.

7 Claims, 6 Drawing Sheets

PRINTING PLATE STORAGE AND TRANSPORTATION SYSTEM

BACKGROUND OF THE INVENTION

1. Field of the Invention

The present invention is directed to an apparatus for storing and transporting printing plates, and to a rack for storing and transporting a plurality of such apparatuses.

2. Description of the Related Art

Printing plates, and in particular aluminum based printing plates, have very sharp edges. Contact with these sharp edges can cause injury, such as skin cuts or even worse. Such injuries are particularly likely during transportation of plural printing plates from one location to another.

Another problem which occurs during the transport of plural printing plates from one location to another is that the edges of the plates are easily damaged. Bending of corners as well as nicks along the edges of the plates and scratches on the printing surfaces of the plates can frequently occur during transport of plural printing plates from a printing plate imaging device to a printing press.

There is also a need in the art to store printing plates in a convenient manner for ease of latter identifying the printing plates and is such a fashion that the printing plates will not be damaged during storage. There is also a need to store a plurality of printing plates together, e.g. for printing a color page, one printing plate would be stored for each of the ink colors required by the color page. This is for a typical color page a separate printing plate for each of the colors, cyan, magenta, yellow and black may be required and ideally would be stored together.

In view of the foregoing, printing plate transportation systems have been developed which ostensibly reduce the likelihood of injuries from plate edges, damage to plate edges and scratching of the imaging surfaces. These systems may also served as convenient printing plate storage devices. Such systems usually take the form of a rack or the like which holds a plurality of printing plates, and which can be moved without actually touching the plates themselves. One such system is shown in U.S. Pat. No. 5,535,898 to Burgess, Sr. et al. Burgess, Sr. et al. teach supporting one or more printing plates on a rack which includes a bracket for supporting the printing plates by a bent over tab provided on each of the printing plates. One problem with such systems, however, is that the plates' edges remain substantially exposed. As a result, injuries caused by the plates' edges and damage to the plates are still relatively likely, particularly during mounting and removal of the plates from the rack. Moreover, there is no convenient way of separating the printing plates according to the application.

To address the foregoing problems, some conventional systems store printing plates in folders which can be hung on a rack. Such a system is available from FOSTERS MANUFACTURING of Philadelphia Pa. One problem with these systems, however, is that the folders are typically made from paper or vinyl and are open at two or three ends, thereby increasing the likelihood that printing plates stored therein will fall out and injure a nearby person or be damaged. Moreover, such systems are also generally limited to storing one plate in each folder due to the limit weight carrying capacity. As a result, using these systems, it is cumbersome, and even dangerous, to transport more than one plate without using the rack, since to do so requires transporting more than one folder, each of which has several open ends that provide a potential for exposure to a plate edge.

Accordingly, there exists a need for a way to store and to transport printing plates safely. In particular, there exists a need for a way to store and to transport printing plates which reduces the likelihood of personal injury from edges thereof and which reduces the likelihood of damaging the printing plate edges and printing surfaces.

SUMMARY OF THE INVENTION

The present invention addresses the foregoing needs by storing a plurality of printing plates in a sleeve having one open end, which encloses all but one edge of each printing plate. By storing the printing plates in a sleeve having one open end, the invention reduces the likelihood of exposure to plate edges during storage, and the likelihood of plates falling out of the sleeve during transport. The invention also includes a handle on each sleeve, which facilitates transport of a plurality of plates without the need for a rack.

Thus, according to one aspect, the present invention is an apparatus which is capable of storing a plurality of printing plates. The apparatus includes a sleeve having one open end which receives the printing plates and a handle connected to the sleeve. In the invention, the sleeve encloses all but one edge of each received printing plate, thereby reducing the likelihood of injuries therefrom or damage thereto.

In preferred embodiments of the invention, the sleeve comprises two mutually-opposed surfaces which enclose each received printing plate such that each enclosed edge of each received printing plate is unexposed external to the apparatus. In these embodiments, at the open end, each of the mutually-opposed surfaces includes a cut-away portion which only partially exposes the one "exposed" edge of each of the printing plates. By reducing plate edge exposure to all but part of one edge of each printing plate, the invention correspondingly reduces the likelihood of injury from edges on the printing plates.

In other preferred embodiments of the invention, the sleeve receives the plurality printing plates vertically. By receiving the printing plates vertically, the invention facilitates storage and removal of the plates.

In particularly preferred embodiments, the apparatus is held on a mobile rack via one or more holes in the apparatus. A representative embodiment of the mobile rack includes one or more hooks for holding the plurality of apparatuses vertically, and wheels for moving the rack. By holding a plurality of the apparatuses vertically, the invention facilitates mounting of the apparatuses on the rack, while still permitting easy storage and withdrawal of individual printing plates within individual apparatuses. Moreover, the rack itself facilitates transport of printing plates from one location to another location.

According to another aspect, the present invention is an apparatus for holding one or more printing plates. The apparatus includes receiving means (e.g., a sleeve) for vertically receiving the one or more printing plates. In the invention, the receiving means is capable of shielding all but one edge of each of the one or more printing plates. Also included in the apparatus are supporting means (e.g., support beams) for providing structural support for the receiving means, and holding means (e.g., a handle), connected to the receiving means, for holding the apparatus.

The advantages noted above are also applicable to this aspect of the invention. Moreover, this aspect of the invention includes supporting means, such as one or more support beams radiating outwardly from a center point of the receiving means, for maintaining structural rigidity of the receiving means. By including such supporting means, the invention is able safely to hold more printing plates than otherwise would be possible.

According to still another aspect, the invention is a method of transporting a plurality of printing plates. The method includes storing the plurality of printing plates in a sleeve having one open end which receives the printing plates and which encloses all but one edge of each received printing plate. The method also includes transporting the printing plates from one location to another location using at least one of (i) a handle connected to the sleeve (e.g., in a case that only one sleeve is to be transported) and (ii) a hole in the handle (e.g., for mounting the sleeve onto a rack for transporting a plurality of sleeves each holding a plurality of printing plates).

As described in more detail below, the foregoing method provides a way to store and to transport printing plates more safely and efficiently than its conventional counterparts described above.

This brief summary has been provided so that the nature of the invention may be understood quickly. A more complete understanding of the invention can be obtained by reference to the following detailed description of the preferred embodiment thereof in connection with the attached drawings.

DETAILED DESCRIPTION OF THE PREFERRED EMBODIMENT

Figure 1:
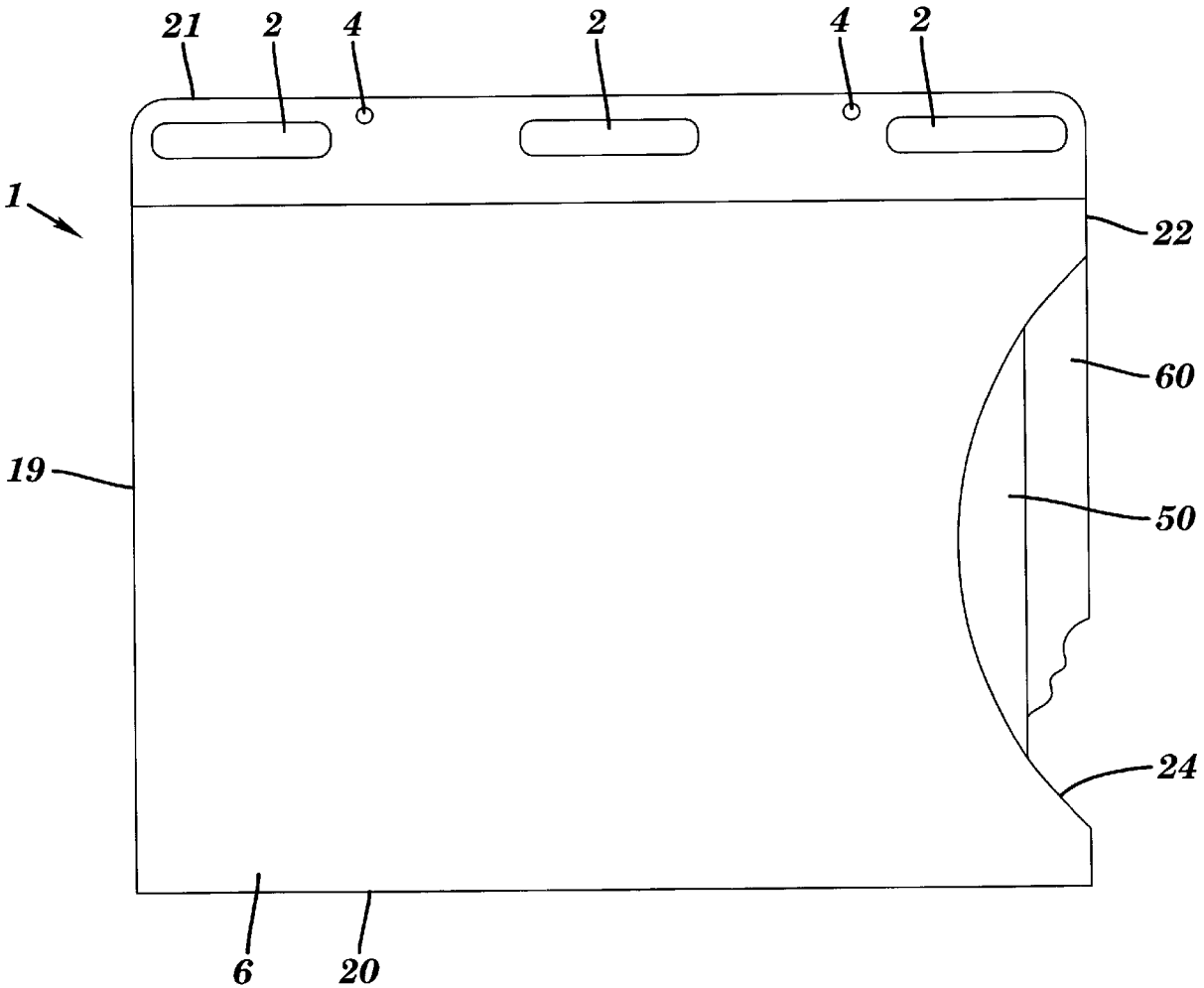
FIG. 1 is a front view of a printing plate storing apparatus in accordance with the present invention.

FIG. 1 shows a representative embodiment of an apparatus for storing printing plates in accordance with the present invention. The apparatus shown in FIG. 1 includes sleeve 1, handles 2, and holes 4. In preferred embodiments of the invention, sleeve 1 is substantially rectangular in shape and is preferably made of a substantially rigid moldable plastic (e.g., ABS) or other substantially rigid material. Of course, sleeve 1 can have any shape or be made of any suitable material; however, for the sake of brevity and clarity, only a substantially rectangular sleeve will be described herein.

Figure 2:
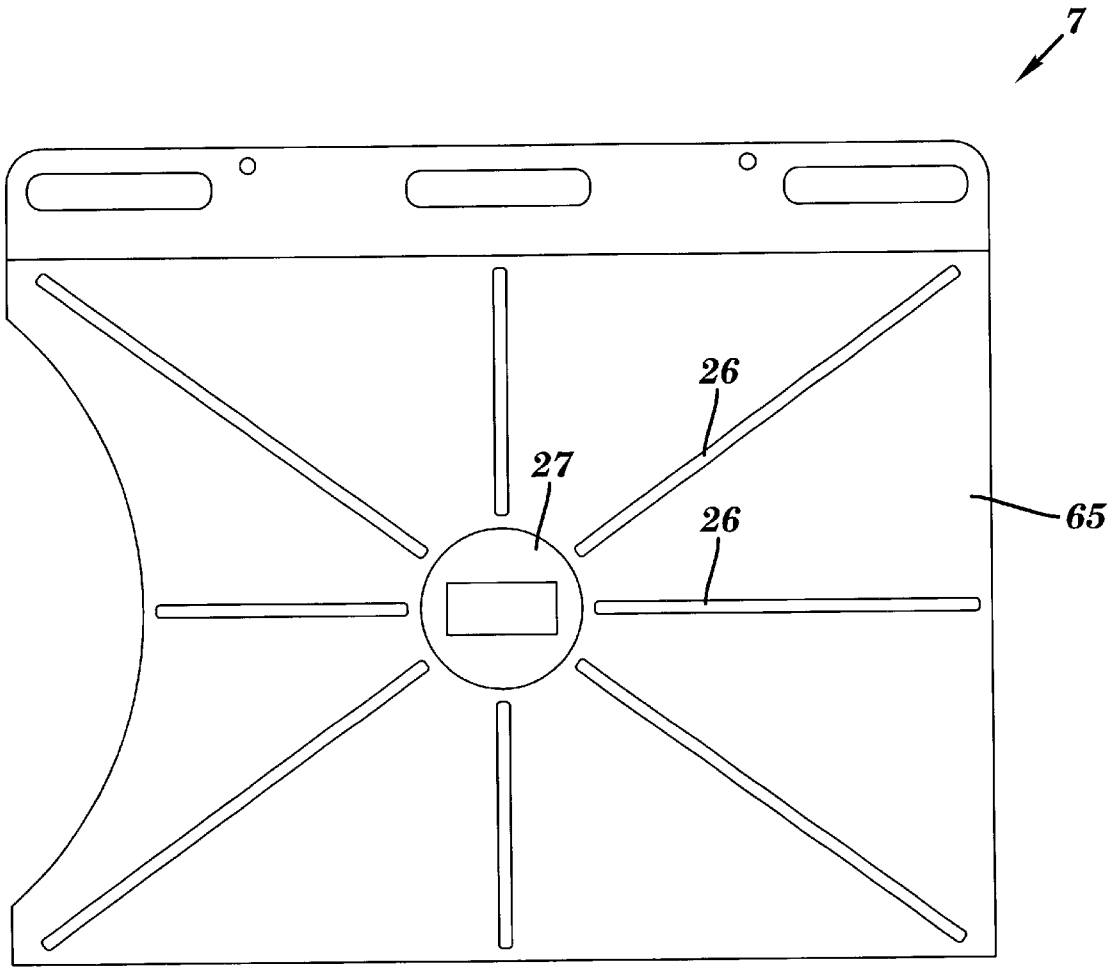
FIG. 2 is a front view of one of two mutually-opposed surfaces which comprise the printing plate storing apparatus of FIG. 1.
Figure 3:
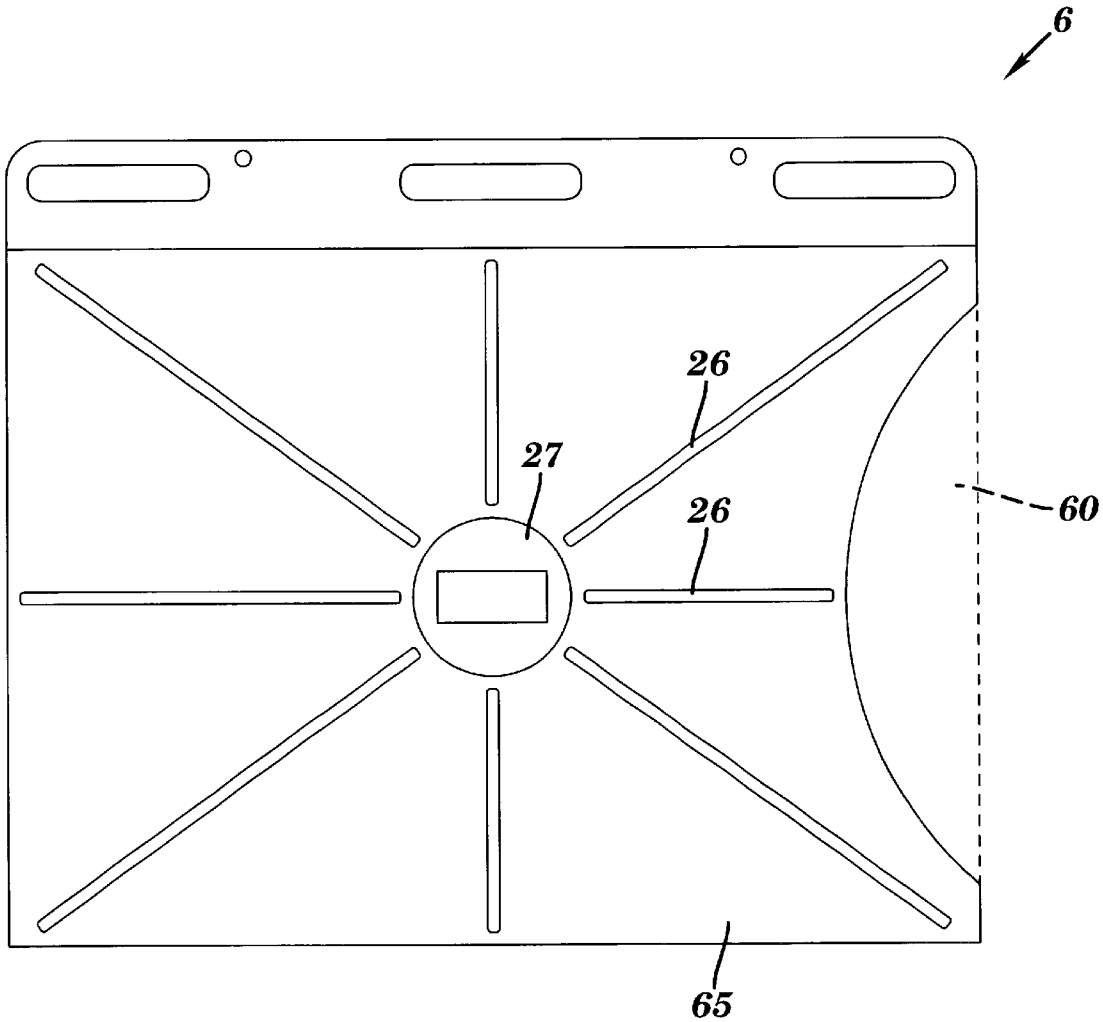
FIG. 3 is a front view of the other one of the mutually-opposed surfaces which comprise the printing plate storing apparatus of FIG. 1.
Figure 4:
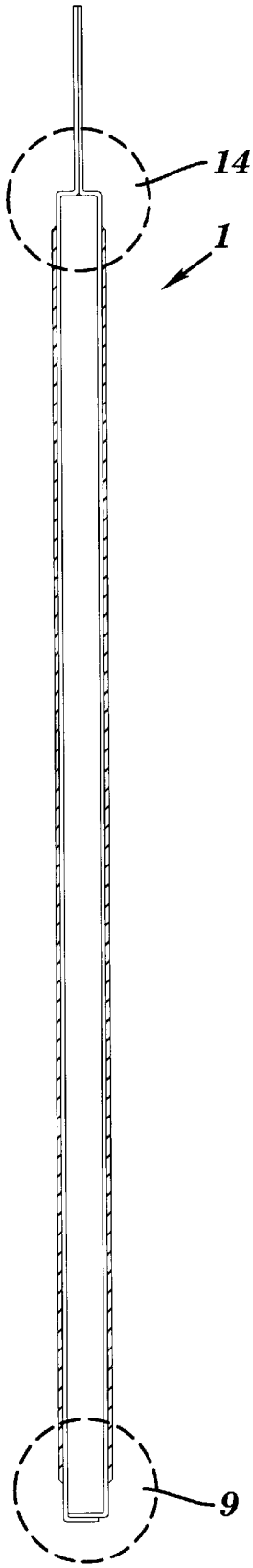
FIG. 4 is a side view of a sleeve formed from the surfaces shown in FIGS. 2 and 3.
Figure 5:
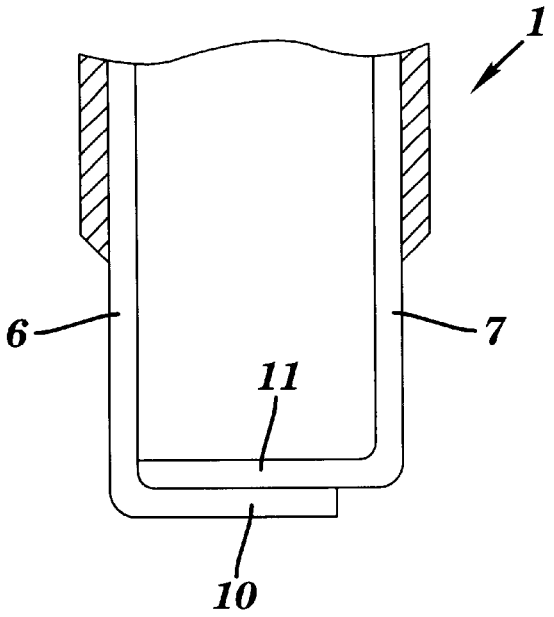
FIG. 5 is a close-up, side view of the bottom of the sleeve shown in FIG. 4, which depicts mating of the mutually-opposed surfaces shown in FIGS. 2 and 3.
Figure 6:
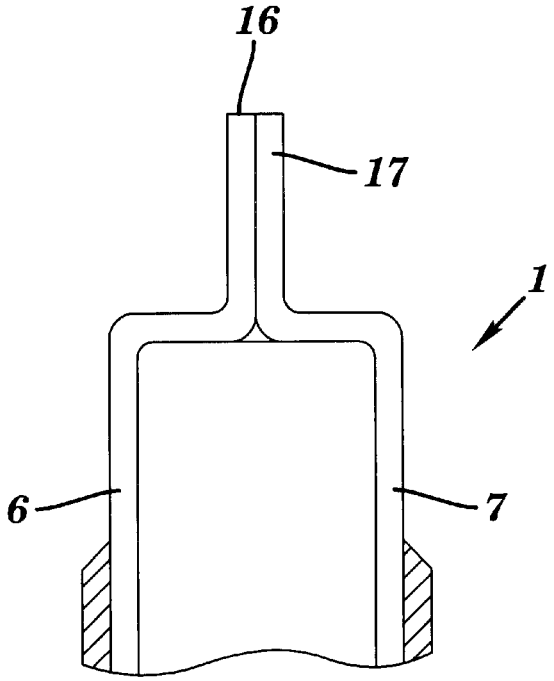
FIG. 6 is a close-up, side view of the top of the sleeve shown in FIG. 4, which depicts mating of the mutually-opposed surfaces shown in FIGS. 2 and 3.

Sleeve 1 is comprised of two mutually-opposed substantially rectangular elements 6 and 7 (shown in FIGS. 2 & 3), each of which is preferably about 0.09 inches thick. FIGS. 2 and 3 are front views of these elements 7 and 6, respectively. FIGS. 4, 5 and 6 show how elements 6 and 7 mate to form sleeve 1. More specifically, at bottom 9 of sleeve 1 (see the side view of sleeve 1 depicted in FIG. 4), elements 6 and 7 include bottom mating portions 10 and 11, respectively, which fit together in the manner shown in FIG. 5. In the preferred embodiment of the invention, these mating portions are held together via a solvent bond. Of course, other fasteners, such as plastic or metal screws, rivets or the like, may be used to hold mating portions 10 and 11 together. At top 14 of sleeve 1 (see the side view of sleeve 1 depicted in FIG. 4), elements 6 and 7 include top mating portions 16 and 17, respectively, which fit together in the manner shown in FIG. 6. In the preferred embodiment of the invention, these mating portions are also held together via a solvent bond; although other materials, such as plastic or metal screws, rivets or the like, may be used to hold these mating portions together in order to form sleeve 1.

When mated, elements 6 and 7 define a sleeve having closed ends 19, 20 and 21 and open end 22 (see FIG. 1). Sleeve 1 receives one or more printing plates via open end 22. In preferred embodiments of the invention, the sleeve 1 is stored vertically, as will be detailed below, such that the printing plates are preferentially inserted into sleeve 1 when sleeve 1 is vertically held, as opposed to laid in a horizontal position. This reduces the possibility of damage to the printing plates, while also providing for ease of access to a plurality of sleeves 1 stored on a rake. That is, since the printing plates are stored vertically, it is relatively easy to access individual printing plates or individual sleeves without having to relocate adjacent plates or sleeves as might be required in a horizontal storage mode.

Printing plates stored in sleeve 1 generally cannot be accessed via closed ends 19, 20 and 21. As a result, once the printing plates have been received by sleeve 1, in preferred embodiments of the invention, the only way to access those printing plates is via open end 22. Of course, the invention can be configured to include more than one open end. However, the fewer the open ends, the less likely it will be that printing plates stored in the apparatus will be damaged or will fall out inadvertently and injure nearby persons.

For safety reasons and to reduce the likelihood of a printing plate being damaged, sleeve 1 is dimensioned so that at least some edges of printing plates stored therein are shielded, meaning that those edges are substantially unexposed external to the sleeve. In this regard, in preferred embodiments of the invention, sleeve 1 is roughly 38 inches (~965 mm) in height by 46 inches (~1168 mm) in length and has a width of about 1 inch (~24 mm). With these dimensions, the apparatus is able to hold 30, or even more, typical-sized printing plates e.g. 44 inches (1118 mm)×36 inches (914 mm) such that, for each printing plate, all four edges thereof fit within the dimensions of the sleeve 1 and at least three of the four edges are substantially unexposed external to the apparatus.

In this regard, sleeve 1 preferably also provides for only partial exposure of the fourth edge 50 of each printing plate stored therein, meaning that sleeve 1 stores the printing plates so that the fourth edge 50 of each plate is partially exposed external to the apparatus for ease of access to the fourth edge 50, e.g. for removing the plate. To provide for such partial exposure of the fourth edge 50, sleeve 1 has greater dimensions than the printing plates to be stored therein, such that all of the corners of the plates are contained within the dimensions of the sleeve 1, but also includes a cut-away portion 24 cut in either one or both of the elements 6 and 7. As shown in FIG. 1, cut-away portion 24 enables a user to access the fourth edges 50 of the printing plates stored in sleeve 1 while still covering all four corners of the plates. When the cut-away portion 24 is provided only in one of the elements e.g. element 7, the fourth edge 50 of the plates is protected even further by element 6 since as shown in phantom in FIG. 3 a portion of element 6 further supports the forth edge 50 and the edge 60 prevents inadvertent contact with the fourth edge 50.

The printing plate storing apparatus of the present invention also includes holding means, such as holes 4 and handles 2. Handles 2 are attached to, and may comprise part of, sleeve 1. As shown in FIGS. 2 and 3, in the preferred embodiment of the apparatus, handles 2 are formed from corresponding openings in surfaces 6 and 7. Of course, handles 2 can be formed in other ways and can be attached to sleeve 1 via any well-known means. Handles 2 are preferably used when manually carrying a single printing plate storing apparatus from one location to another location. In this regard, the invention also includes holes 4, as shown in FIG. 1. Holes 4 are used to hang the apparatus vertically on a mobile rack that is used to move the apparatus and/or one or more other apparatuses like it, from one location to another. A preferred embodiment of such a mobile rack is described in more detail below.

As shown in FIGS. 2 and 3, elements 6 and 7 include a plurality of stiffening members 26 therein. In the preferred embodiment of the invention, these stiffening members extend radially outward relative to area 27 (e.g., a substantial center) of sleeve 1. Stiffening members 26 are formed during the molding process to provide structural support for sleeve 1 and may be formed e.g. as hollow ribs having stiffening side walls which are substantially perpendicular to the surround surface 65 and a top section which substantially parallel to the surface 65. The stiffening members 26 may also comprise solid ribs which may be bonded or otherwise fastened to the surface 65. That is, stiffening members 26 are used to maintain sleeve 1 substantially rigid. This facilitates storage and removal of printing plates from sleeve 1. At this point, it is noted that although FIGS. 2 and 3 show stiffening members 26 arranged radially relative to a substantial center of each of surfaces 6 and 7, stiffening members 26 may be arranged in any manner, e.g., vertically, horizontally, in a cross-hatch fashion, etc., so long as the arrangement of the support beams provides support for sleeve 1.

Figure 7:
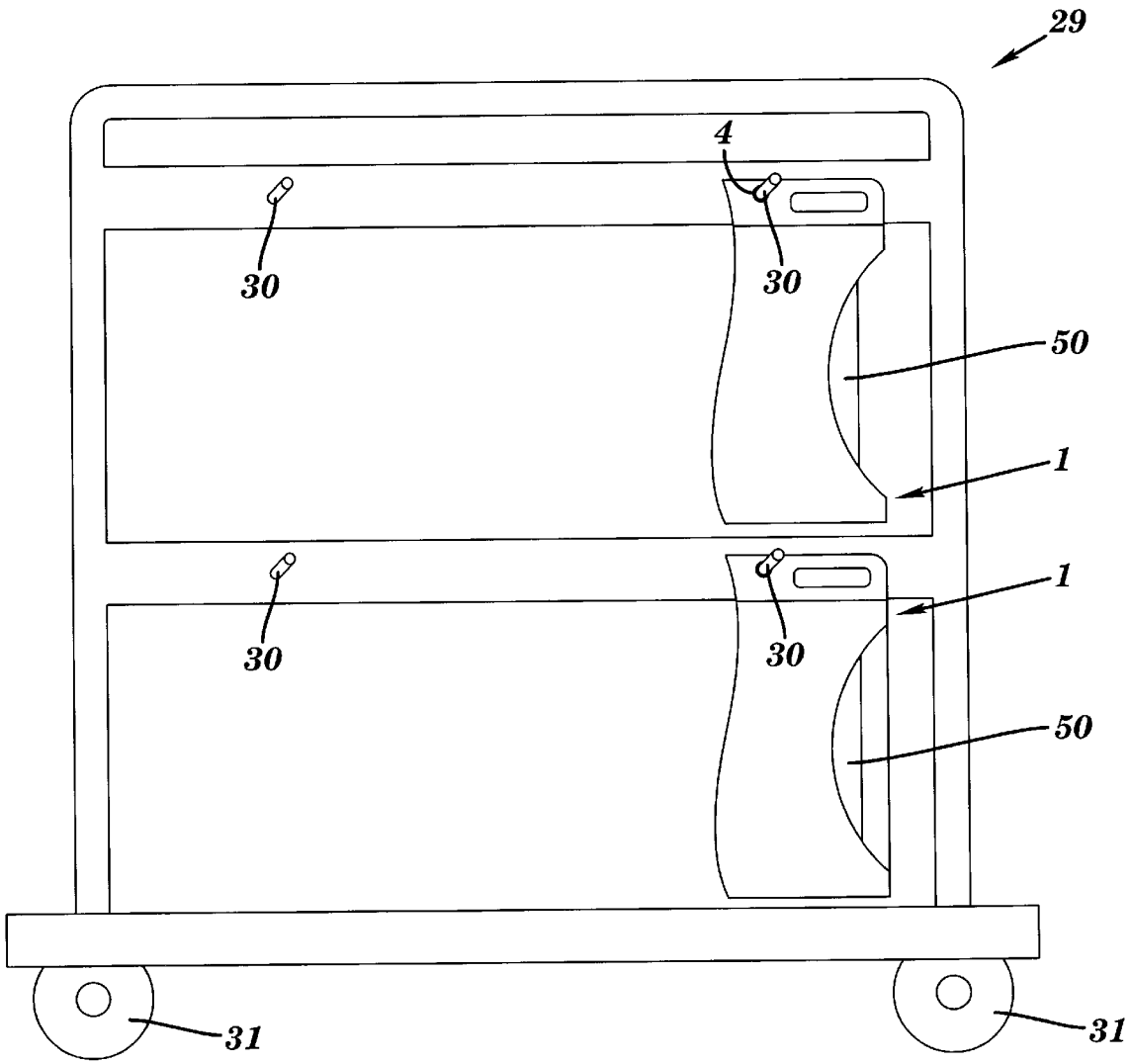
FIG. 7 is a view of a mobile rack used to hang one or more of the printing plate storing apparatuses shown in FIG. 1.

FIG. 7 shows a perspective view of mobile rack 29, on which one or more printing plate holding apparatuses of the type shown in FIG. 1 may be hung. More specifically, as shown in FIG. 7, mobile rack 29 includes one or more holding means 30 (e.g., hooks, bars, etc.) which hold the apparatuses via holes 4 therein. That is, the apparatuses are hung on these hooks vertically with the fourth edge 50 perpendicular to vertical so as to transport the apparatuses from one location to another location. To this end, mobile rack 29 also includes wheels 31 for moving the rack across a floor. Thus, by hanging a plurality of printing plate holding apparatuses on mobile rack 29, it is possible to transport a plurality of printing plates both quickly and safely.

The present invention has been described with respect to a particular illustrative embodiment. It is to be understood that the invention is not limited to the above-described embodiment and modifications thereto, and that various changes and modifications may be made by those of ordinary skill in the art without departing from the spirit and scope of the appended claims.

What is claimed is:

1. An apparatus for storing a rectangular printing plate comprising:

a sleeve having a first planar surface, a second planar surface, and one open end, said sleeve being configured to hold a rectangular printing plate such that all comers of the rectangular printing plate are enclosed within the sleeve and only a portion of one edge of the rectangular printing plate is disposed external to the sleeve, said sleeve further including a plurality of stiffening members on each of said first and second planar surfaces and extending radially outwardly relative to a center area of the respective surface; and a handle connected to the sleeve.

2. An apparatus according to claim 1, wherein the sleeve includes a cut-away portion at the open end for exposing the portion of the edge of the rectangular printing plate disposed external to the sleeve.

3. An apparatus according to claim 1, wherein the handle includes at least one hole for transporting the sleeve.

4. An apparatus according to claim 1, wherein the handle includes a plurality of holes for hanging the apparatus.

5. The apparatus according to claim 1, wherein the sleeve is further configured to hold a plurality of rectangular printing plates.

6. The apparatus according to claim 1, wherein the sleeve is made of moldable plastic.

7. Wherein the sleeve further has a handle connected to at least one of said planar surface and said sleeve further includes a plurality of stiffening members on at least one of said planar surface and extending radially outwardly relative to a center area of said surface.

* * * * *